US008271126B2

(12) United States Patent
Zimmermann

(10) Patent No.: US 8,271,126 B2
(45) Date of Patent: Sep. 18, 2012

(54) METHOD AND CONFIGURATION FOR HANDLING OBJECTS

(75) Inventor: Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/987,289

(22) Filed: Jan. 10, 2011

(65) Prior Publication Data

US 2011/0172809 A1 Jul. 14, 2011

(30) Foreign Application Priority Data

Jan. 8, 2010 (DE) ..... 10 2010 004 194

(51) Int. Cl.
*B07C 5/00* (2006.01)

(52) U.S. Cl. ..... 700/218; 700/214; 414/800; 209/584

(58) Field of Classification Search ..... 700/218
See application file for complete search history.

(56) References Cited

U.S. PATENT DOCUMENTS

| | | | | |
|---|---|---|---|---|
| 5,022,531 | A * | 6/1991 | Horino et al. | 209/552 |
| 5,230,206 | A | 7/1993 | Christ | |
| 7,397,010 | B2 * | 7/2008 | Wilke | 209/584 |
| 2006/0122858 | A1 | 6/2006 | Miles et al. | |
| 2006/0124512 | A1 * | 6/2006 | Quine et al. | 209/584 |
| 2006/0180520 | A1 * | 8/2006 | Ehrat et al. | 209/584 |
| 2006/0253405 | A1 | 11/2006 | Nirenberg | |
| 2007/0226088 | A1 | 9/2007 | Miles et al. | |
| 2007/0293981 | A1 * | 12/2007 | Rai | 700/223 |
| 2008/0154751 | A1 | 6/2008 | Miles | |
| 2009/0218261 | A1 | 9/2009 | Berdelle-Hilge | |

FOREIGN PATENT DOCUMENTS

| | | | |
|---|---|---|---|
| DE | 40 15 935 | A1 | 11/1991 |
| DE | 299 14 211 | U1 | 11/1999 |
| EP | 2 095 887 | A1 | 9/2009 |

* cited by examiner

*Primary Examiner* — Gene Crawford
*Assistant Examiner* — Kyle Logan
(74) *Attorney, Agent, or Firm* — Laurence A. Greenberg; Werner H. Stemer; Ralph E. Locher

(57) ABSTRACT

A method and a configuration for handling objects, wherein a multiplicity of objects are stored in a storage container and one or more objects to be processed are divided from objects to remain in storage. Depending on the number of objects to be processed or depending on a differential value between the total number of objects in the storage container and the number of objects to be processed, a decision is made whether the division of the object or objects to be processed from the objects to remain in storage takes place in the storage container by the object or objects to be processed being removed directly from the storage container, the objects to remain in storage remaining in the storage container during said removal operation, or whether the division of the object or the objects to be processed from the objects to remain in storage takes place outside the storage container by all of the objects being removed from the storage container and the division of the objects to be processed from the objects to remain in storage taking place separately from the storage container.

4 Claims, 4 Drawing Sheets

METHOD AND CONFIGURATION FOR HANDLING OBJECTS

CROSS-REFERENCE TO RELATED APPLICATION

This application claims the priority, under 35 U.S.C. §119, of German patent application DE 10 2010 004 194.7, filed Jan. 8, 2010; the prior application is herewith incorporated by reference in its entirety.

BACKGROUND OF THE INVENTION

Field of the Invention

The invention relates to a method and to a configuration for handling objects. The objects may be, for example, flat objects, the thickness of which is less than the height and width thereof. For example, the objects are items of letter mail.

A method for handling objects is known, for example, from patent application publication US 2006/0122858 A1. In that prior art method, objects, such as, for example, items of letter mail, are stored in storage located away from the object owners. In order to store the objects, the latter are at least partially recorded in image form. In addition, each object is assigned an individual identification. The position of the object in the storage location is linked to the individual identification and saved.

Another method for handling objects is described in patent application publication US 2006/0253405 A1. There, items of letter mail are recorded with the aid of a scanner. A workstation is provided to transmit an image, which is recorded by the scanner, of the item of letter mail together with a related, second image to a receiver located remotely in order to obtain instructions regarding the handling of the particular item of letter mail.

Patent application publication US 2008/0154751 A1 discloses a method for handling objects, in which objects are stored in a store, with information regarding the size of the respective objects being recorded. The objects are stored depending on the respective object size.

Patent application publication US 2007/0226088 A1 discloses a method for storing items of letter mail, in which the movement of the items of letter mail is followed with the aid of a video device.

Commonly assigned patent application publication US 2009/0218261 A1 and its counterpart European published patent application EP 2 095 887 A1 disclose an apparatus for sorting objects, with an input conveying device, an output conveying device, two loading devices and two unloading devices. The apparatus can be switched over between an input-optimized mode and an output-optimized mode. In the input-optimized mode, both loading devices, but only one unloading device are activated, and the input conveying device is guided past the two loading devices and the output conveying device is guided past the activated unloading device. In the output-optimized mode, only one loading device, but both unloading devices are activated, and the input conveying device is guided past the activated loading device and the output conveying device is guided past the two unloading devices.

U.S. Pat. No. 5,230,206 and its counterpart German published patent application DE 40 15 935 A1 disclose a method for ordering articles supplied in bundles. In the method, supplied bundles are temporarily stored, the articles are separated from the bundles as required, the articles separated from the bundles are distributed to one or more shelf sections of a pass-through storage facility and the individual articles of an order to be assembled are retrieved from the pass-through storage facility as per requirement.

German utility model DE 299 14 211 U1 describes a container which can be closed by a cover and is intended for storing and transporting medicaments and medical instruments.

SUMMARY OF THE INVENTION

It is accordingly an object of the invention to provide a method and apparatus for handling objects which overcome the above-mentioned disadvantages of the heretofore-known devices and methods of this general type and in which stored objects are removed from a storage container as efficiently as possible.

With the foregoing and other objects in view there is provided, in accordance with the invention, a method of handling objects, which comprises:

storing a multiplicity of objects in a storage container; and separating one or more objects to be processed from objects to remain in storage;

deciding, in dependence on a number of objects to be processed or depending on a differential value between a total number of the objects in the storage container and the number of the objects to be processed, whether:

- a separation of the object or objects to be processed from the objects to remain in storage should be carried out in the storage container by directly removing the object or objects to be processed from the storage container and retaining the objects to remain in storage in the storage container during the removal of the object or objects to be processed; or
- a separation of the object or objects to be processed from the objects to remain in storage should be carried out outside the storage container by removing all of the objects from the storage container and separating the object or objects to be processed from the objects to remain in storage separately from the storage container.

In other words, the objects of the invention are achieved in that a multiplicity of objects are stored in a storage container and one or more objects to be processed are divided from objects to remain in storage by a decision being made depending on the number of objects to be processed or depending on a differential value between the total number of objects in the storage container and the number of objects to be processed whether the division of the object or objects to be processed from the objects to remain in storage takes place in the storage container by the object or objects to be processed being removed directly from the storage container, the objects to remain in storage remaining in the storage container during the removal operation, or whether the division of the object or the objects to be processed from the objects to remain in storage takes place outside the storage container by all of the objects being removed from the storage container and the division of the objects to be processed from the objects to remain in storage taking place separately from the storage container. "To remain in storage" means for a longer time than the objects to be processed.

A substantial advantage of the method according to the invention is that the removal of one or more objects from the storage container storing the objects is carried out very effectively since, namely, complete removal of all of the objects in the receiving container is carried out only if this appears expedient because of the number of objects to be processed or the number of objects not to be processed. If this is not the case, removal of the objects to be processed takes place directly from the storage container, wherein the objects to remain in storage remain in the storage container during the removal operation.

According to a preferred refinement of the method, it is checked whether the differential value between the total number of objects in the storage container and the number of objects to be processed falls short of a predetermined differential threshold value, and a decision is made depending on the result of the check regarding the procedure for the division of the object or objects to be processed from the objects to remain in storage.

The division of the object or objects to be processed from the objects to remain in storage is preferably carried out outside the storage container if the differential value between the total number of objects in the storage container and the number of objects to be processed falls short of the predetermined differential threshold value.

As an alternative or in addition, provision can be made for it to be checked whether the number of objects to be processed exceeds a predetermined removal threshold value, and for a decision to be made depending on the result of the check regarding the procedure for the division of the object or objects to be processed from the objects to remain in storage.

The division of the object or objects to be processed from the objects to remain in storage preferably takes place outside the storage container if the number of objects to be processed exceeds the predetermined removal threshold value.

According to a particularly preferred refinement of the method, two checking steps are carried out, namely a first checking step in which it is checked whether the differential value between the total number of objects in the storage container and the number of objects to be processed falls short of a predetermined differential threshold value, and another checking step in which it is checked whether the number of objects to be processed exceeds a predetermined removal threshold value, and a decision is made depending on the result of both of the checks regarding the procedure for the division of the object or objects to be processed from the objects to remain in storage.

The first checking step can be carried out temporally before or after the second checking step; it is also possible for both checking steps to be carried out at the same time.

If both checking steps are carried out—no matter in which temporal sequence—it is considered advantageous when the division of the object or objects to be processed from the objects to remain in storage takes place in the storage container if the differential value between the total number of objects in the storage container and the number of objects to be processed exceeds the predetermined differential threshold value or is equal thereto and the number of objects to be processed falls short of the predetermined removal threshold value or is equal thereto. The division of the object or objects to be processed from the objects to remain in storage preferably takes place outside the storage container when the differential value between the total number of objects in the storage container and the number of objects to be processed falls short of the predetermined differential threshold value or the number of objects to be processed exceeds the predetermined removal threshold value.

With regard to the removal outside the storage container, it is considered advantageous if all of the objects of the storage container are fed into a sorting machine and the sorting machine separates all of the objects and divides the objects to be processed from the objects to remain in storage.

Furthermore, it is considered advantageous if, after the division, the objects to remain in storage are put into one or more storage containers and are stored therein until a later removal, wherein the putting of the objects to remain in storage into the storage containers takes place in a sorted manner according to object size and/or according to a further prospective storage time of the respective objects by the storage containers each being assigned an object size region and/or a storage time region, and the objects being put into one of the respectively assigned storage containers depending on their object size and/or further prospective storage time and being stored therein.

The division of the object or objects to be processed from the objects to remain in storage preferably takes place in the storage container by the objects to be processed being gripped from the side or from above and being removed from the storage container.

Provision can also be made for gripping to take place through openings in the container floor of the receiving container in order to raise the objects to be processed from below and subsequently to grip the objects from the side or from above in order to remove the objects from the storage container.

All of the objects in the storage container are particularly preferably raised one after another, but only the objects to be processed are gripped and removed.

It is considered advantageous if a decision is made as to which object is removed from the receiving container with reference to a stored position of the objects within the receiving container.

During the raising of the objects, it is preferably counted how many objects are involved, and a decision is made on the basis of the count of the counter as to which object is gripped and removed.

As an alternative or in addition, a decision can be made with reference to a coding attached to the respective object as to which object is gripped and removed.

The coding for the objects can be predetermined, for example, individually of the container or individually for the object, i.e. independently of the container, or globally.

Each object prior to the removal thereof from the receiving container is preferably divided from adjacent objects in the receiving container by means of a dividing device, for example with the aid of bristles.

According to a further preferred refinement, a pull tab is fastened, for example adhesively bonded, to an upper edge of the objects, and the pull tabs are combed through. In such a refinement of the method, an object can be removed by the pull tab thereof being gripped.

As the pull tabs are being combed through, the pull tabs, for example, can be counted, and a decision can be made on the basis of the count of the counter as to whether an object is removed.

As an alternative or in addition, the pull tabs can be investigated for a coding. In such a case, a decision can be made to remove an object if the coding thereof on the pull tab corresponds to a predetermined coding.

With the above and other objects in view there is also provided, in accordance with the invention, a configuration for handling objects. The configuration is equipped to divide at least one object to be processed and that is stored in a storage container from objects that are to remain in storage in the storage container. The system comprises:

a first removal device and a second removal device;

a switch configured for selectively feeding the storage container into the first removal device or into the second removal device; and a control device connected to the switch, the control device being configured to activate the switch depending on a number of objects to be processed or depending on a differential value between a total number of objects in the storage container and the number of objects to be processed and to allow the storage container to be fed by the switch into the first removal device or the second removal device;

the first removal device being configured to separate the object or objects to be processed from the objects to remain in storage inside the storage container and to remove the object or objects to be processed directly from the storage container, while the objects to remain in storage remain in the storage container during the removal operation; and the second removal device being configured to remove all of the objects from the storage container and to separate the object or objects to be processed from the objects to remain in storage outside of and separated from the storage container.

In other words, according to the invention, the configuration is suitable for dividing at least one object which is stored in a storage container and is to be processed from objects to remain in storage in the storage container, the configuration having a switch which is suitable for feeding the storage container into a first or a second removal device, and a control device being connected to the switch, which control device is suitable to activate the switch depending on the number of objects to be processed or depending on a differential value between the total number of objects in the storage container and the number of objects to be processed and to allow the storage container to be fed by the switch into the first or the second removal device, the first removal device being configured in such a manner that the division of the object or the objects to be processed from the objects to remain in storage takes place in the storage container by the object or the objects to be processed being removed directly from the storage container, the objects to remain in storage remaining in the storage container during said removal operation, and the second removal device being configured in such a manner that the division of the object or the objects to be processed from the objects to remain in storage takes place outside the storage container by all of the objects being removed from the storage container and the division of the objects to be processed from the objects to remain in storage being carried out separately from the storage container.

As regards the advantages of the configuration according to the invention, reference should be made to the above explanations in conjunction with the method according to the invention, since the advantages of the method according to the invention substantially correspond to those of the configuration according to the invention. The second removal device preferably has a sorting machine which is connected to the control device and is suitable for picking up all of the objects out of the storage container, for separating said objects, for dividing the objects to be processed from the objects to remain in storage, for sorting the objects to remain in storage according to object size and/or further storage time and for putting said objects into assigned storage containers depending on their object size and/or further storage time.

The invention furthermore relates to a removal device, for example for a configuration, as described above. With regard to a removal device of this type, according to the invention the removal device has a gripping device which is suitable for gripping the objects to be processed, preferably from the side or from above and to remove said objects from a storage container, preferably from the side or from above.

The removal device preferably has a reading device which is suitable for reading a coding attached to the objects. The removal device is preferably suitable for deciding on the basis of the coding of the objects which object is gripped and removed and which is not.

The removal device can also have a dividing device which is suitable for dividing each object prior to the removal thereof from the receiving container from adjacent objects in the receiving container. A dividing device of this type may have, for example, dividing bristles.

The removal device may also have a pull tab combing device which is suitable for combing through pull tabs on the objects.

Furthermore, the removal device may also comprise a pull tab counting device which is suitable for counting the pull tabs as the pull tabs are being combed through. The removal device is particularly preferably suitable for deciding on the basis of the count of the counter of the pull tab counting device whether an object is removed or not.

As an alternative or in addition, the removal device may comprise a pull tab reading device which is suitable for reading a coding on the pull tabs. In such a refinement, the removal device is preferably suitable for deciding on the basis of the pull tab coding whether an object is removed or not.

The removal device may also have a raising device which is suitable for reaching through openings in the container base of the receiving container in order to raise the objects to be processed and to be removed from below. In such a refinement, the removal device preferably has a gripping device which is suitable for gripping and removing the raised objects.

The raising device may have, for example, a double cone spindle which is suitable for raising the objects. The raising device may also have a driving roller which is suitable for driving the double cone spindle.

As an alternative or in addition, the raising device may have a displaceable push-in wedge which is suitable for raising the objects.

The removal device may also have a counting device which is suitable for counting how many raised objects are involved during the object-raising operation. In such a case, the removal device is preferably also suitable for deciding on the basis of the count of the counter which raised object is gripped and removed and which is not.

A gripping device of the removal device preferably comprises at least one gripping roll or at least one gripping cheek for gripping the objects.

Other features which are considered as characteristic for the invention are set forth in the appended claims.

Although the invention is illustrated and described herein as embodied in a method and configuration for handling objects, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the figures, for the sake of clarity, the same reference symbols are always used for identical or comparable components.

Figure 1:
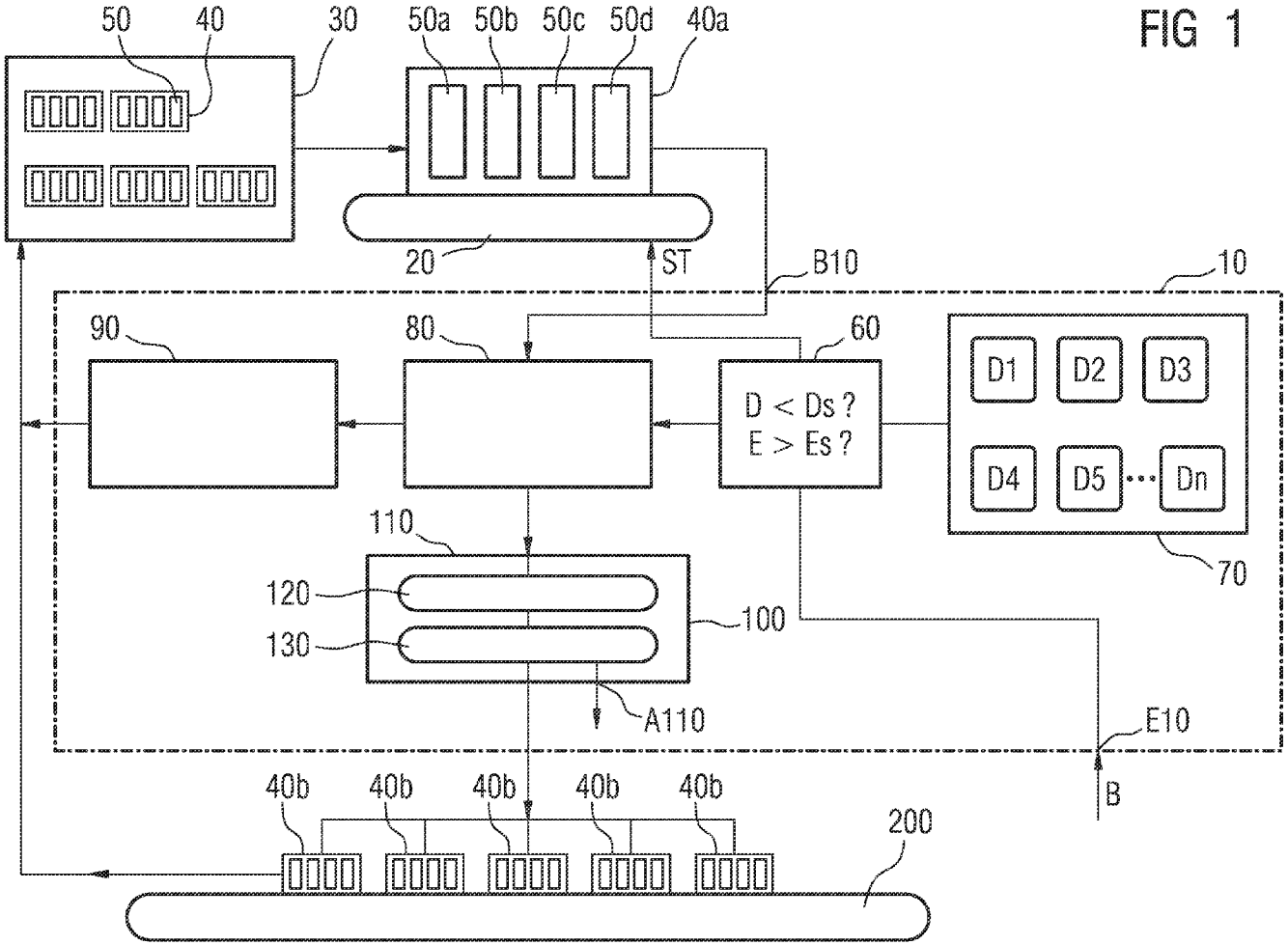
FIG. 1 shows an exemplary embodiment for a configuration for handling stored objects with two removal devices.

Referring now to the figures of the drawing in detail and first, particularly, to FIG. 1 thereof, there is shown an exemplary embodiment for a configuration 10 for handling objects. It can be seen that the configuration 10 is connected to a storage device 30 via a transport device 20. A multiplicity of storage containers 40 is stored in the storage device 30. One or more objects 50 are in each case stored in each storage container 40.

The configuration 10 has a control device 60 which is connected to a database 70. Data records D1, D2, D3, D4, D5 to Dn are stored in the database 70. The data records D1 to Dn each describe the contents of the storage containers 40 stored in the storage device 30.

Furthermore, a switch 80 is connected to the control device 60, the switch being connected on the input side to a container input B10 of the configuration 10. On the output side, the switch 80 is connected to a first removal device 90 and to a second removal device 100.

The first removal device 90 is configured in such a manner that a division of objects which are to be removed from a storage container 40 and are subsequently to be processed from the objects to remain in storage in the storage container takes place by the object or the objects to be processed being removed directly from the storage container, the objects to remain in storage remaining in the storage container during said removal operation.

The second removal device 100 is configured differently, specifically in such a manner that division of objects which are to be removed and processed from objects to remain in storage takes place outside the storage container by all of the objects being removed from the storage container and the division of the objects to be processed from the objects to remain in storage being carried out separately from the storage container. The second removal device 100 can comprise, for example, a sorting machine 110 which has a separator 120 and a sorting unit 130. The function of the separator 120 is to completely remove objects stored in a storage container and to separate said objects and feed said objects separately into the sorting device 130 which subsequently sorts the objects.

As can furthermore be seen in FIG. 1, the control device 60 is connected to the transport device 20 such that the control device 60 is capable of activating the transport device 20 via a control signal ST.

The control device 60 is also connected to a control input E10 of the configuration 10, via which a removal command B for removing one or more objects from the storage device 30 can be fed into the control device 60.

The configuration according to FIG. 1 can be operated, for example, as follows.

If a removal command B is fed into the control device 60 via the control input E10 by a user, the control device 60 determines with the aid of the data records D1 to Dn fed into the database 70 which storage container 40 or storage containers 40 stored in the storage device 30 is or are effected by the removal command. The control device 60 subsequently activates the transport device 20 with the aid of the control signal ST in such a manner that the affected storage containers 40 are transported to the container input B10 of the configuration 10 by means of the transport device 20.

It is assumed by way of example below that the control device 60 activates the transport device 20 in such a manner that a storage container 40*a* having four objects 50*a*, 50*b*, 50*c* and 50*d* is fed into the configuration 10, since the object 50*c* in the storage container 40*a* is intended to be removed and processed. With regard to the remaining objects 50*a*, 50*b* and 50*d*, it is assumed by way of example that said objects are not to be processed and are intended to remain in storage.

The storage container 40*a* therefore passes via the transport device 20 to the container input B10 of the configuration 10 and therefore to the switch 80. The switch 80 is controlled by the control device 60 depending on the number E of objects to be processed and depending on a differential value D between the total number A of objects in the storage container and the number E of objects to be processed. For this purpose, the control device 60 carries out two checking steps, namely one checking step in which it is checked whether the differential value D between the total number A of objects in the storage container and the number E of objects to be processed falls short of a predetermined differential threshold value Ds. In another checking step, the control device 60 checks whether the number E of objects to be processed exceeds a predetermined removal threshold value Es. Depending on both checking steps, the switch 80 is either activated in such a manner that the storage container 40*a* is fed into the first removal device 90 or alternatively into the second removal device 100.

The control device 60 with the aid of the switch 80 will permit feeding to the first removal device 90 if the differential value D between the total number A of objects in the storage container and the number E of objects which are to be processed and removed exceeds the predetermined differential threshold value Ds or is equal thereto and the number E of objects to be processed falls short of the predetermined removal threshold value Es or is equal thereto.

It is assumed by way of example below that the predetermined differential threshold value Ds is 3 and the removal threshold value Es is 2. In the present case, with the differential threshold value Ds and the removal threshold value Es being defined in such a manner, the storage container 40*a* is fed into the first removal device 90 since the following is true:

$$D=A-E=4-1=3=Ds \text{ and}$$

$$E=1<Es=2.$$

Owing to both results of the checks, the storage container 40*a* therefore passes to the first removal device 90 in which the object 50*c* to be processed is removed directly from the storage container 40*a*, with the objects 50*a*, 50*b* and 50*d* to remain in storage remaining in the storage container 40*a* during said removal operation. The storage container 40*a* is subsequently transported to the storage device 30.

The manner of operation of the first removal device 90 is explained in more detail further below with reference to exemplary embodiments in conjunction with FIGS. 2 to 7.

The manner of operation of the configuration 10 will now be explained below if three objects, namely the objects 50*a*, 50*b* and 50*c*, are intended to be removed from the storage container 40*a* for the purpose of processing. In such a case, the control device 60 will establish that the differential value D between the total number A (A=4) of objects in the storage container 40*a* and the number E (E=3) of objects which are to be processed and are to be removed for this purpose falls short of the predetermined differential threshold value Ds (Ds=3) and also the number E of objects to be processed exceeds the predetermined removal threshold value Ds. Owing to the result of said check, the control device 60 will activate the switch 80 in such a manner that the storage container 40*a* is fed into the sorting machine 110 and therefore passes to the separator 120. The separator 120 will completely empty the storage container 40*a* and will separate all of the objects 50*a* to 50*d* located therein and feed said objects separately into the sorting unit 130. The sorting unit 130 will recognize the objects 50*a* to 50*c* to be processed and will separate said objects from the remaining objects and output said objects at an output A110.

The remaining objects which are not intended to be processed, i.e. the object 50*d* in this case, are fed again into a storage container 40*b* by the sorting machine 110. The storage container 40*b* into which said feed takes place depends on the object size of the object 50*d* and on the anticipated further storage time of the object 50*d*. This is because the sorting machine 110 will advantageously place the objects to remain in storage into the storage containers in such a manner that objects having a comparable, anticipated further storage time and comparable storage size are accommodated in the same storage container or storage containers. This facilitates the handling of the objects and, furthermore, the efficiency of storing the objects in the storage device 30.

The storage container or storage containers 40*b* filled by the sorting machine 110 is or are transported via a further transport device 200 to the storage device 30 so that the storage containers 40*b* can continue to be stored in the storage device 30.

Figure 2:
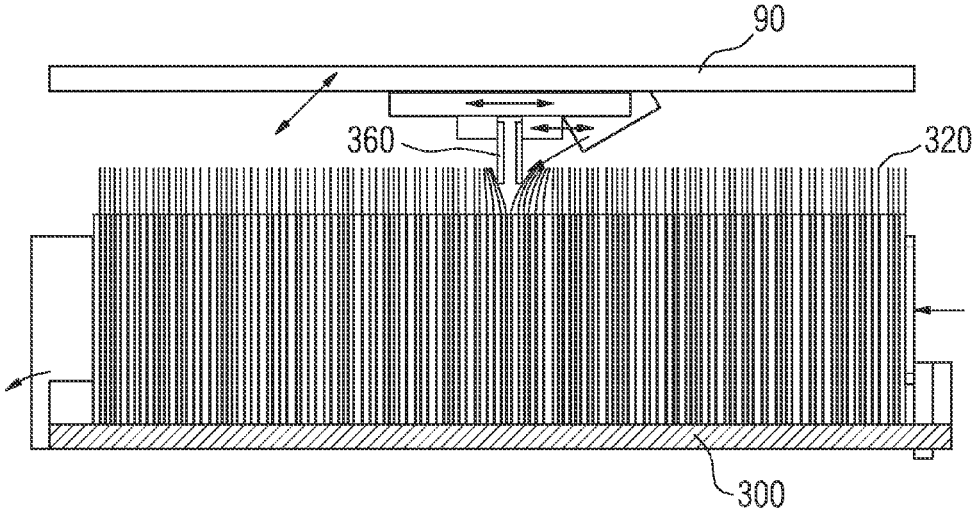
FIGS. 2 and 3 show a first exemplary embodiment for a removal device for the configuration according to FIG. 1.
Figure 3:
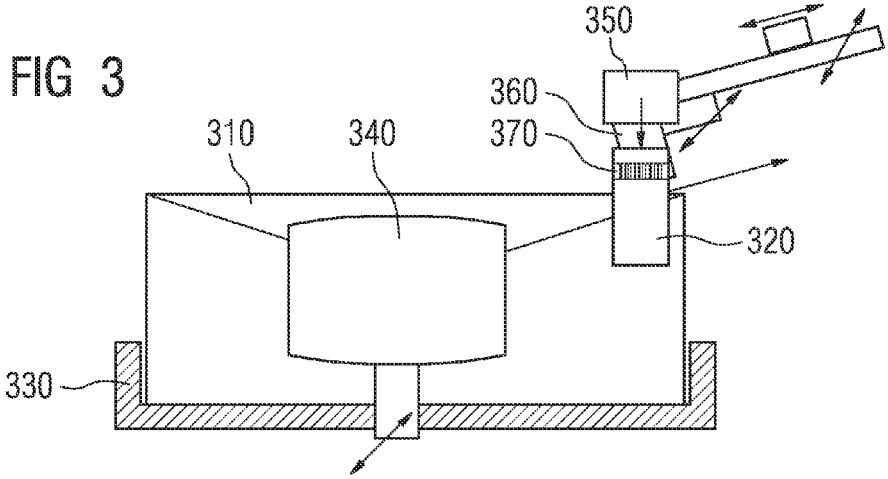

FIGS. 2 and 3 show an exemplary embodiment for the first removal device 90 according to FIG. 1; FIG. 2 shows a view from the side and FIG. 3 shows a view from the front.

FIGS. 2 and 3 show an object stack in the form of a mail stack 300 consisting of items of mail 310 of identical or at least approximately identical mail formats, onto which a respective thin pull tab 320 has been attached in a prior process.

The mail stack 300 is situated in a storage container 330 and is pressed with a defined force against a rear wall of the storage container by means of a stack support 340. The storage container 330 is held in the removal device 90.

A sensor 350, for example an optical sensor in the form of a sheet counter and/or barcode reader, is used to identify the item of mail to be removed, the absolute position region of which within the storage container 330 and the relative position of which to other items of mail of a control unit of the receiving device 90 is preferably known.

A gripping device 360 which can move along the arrow directions shown in FIGS. 2 and 3 to the position of the item of mail to be removed is used to grasp the item of mail and pull said item of mail obliquely out of the remaining stack.

The storage container is preferably configured in such a manner that the item of mail to be separated can be pulled out via a stripping edge but the remaining items of mail are retained by the stripping edge.

The gripping device 360 can be located, for example, on a slide 630. Gripping elements in the form of gripper cheeks of the gripping device 360 are preferably configured to be relatively narrow and pointed and may be displaceable, for example, horizontally independently of each other and vertically as a pair.

In order to grasp an item of mail by way of the pull tab thereof, the gripper cheeks are positioned, for example, on the adjacent interstices between the pull tabs of the item of mail to be removed, are displaced downward along said interstices and subsequently brought together. The item of mail gripped in this manner by way of the pull tab thereof can then be pulled out obliquely upward.

The adjacent pull tabs are advantageously deflected laterally by the gripping device 360 before the gripper cheeks are advanced, as a result of which the gripper cheeks can safely be submerged into the interstices. An offset attachment of the pull tabs on the items of mail is also possible in order to be able to allow the gripper cheeks to be safely submerged into the interstices.

Each pull tab advantageously has an unambiguous identification feature, for example in the form of a barcode 370.

The storage container 330 is preferably designed in such a manner that the rear wall is pivotable. This makes it possible, for example, to insert items of mail by the edge into the storage container and/or to feed the entire mail stack into a sorting machine.

In addition or as an alternative to gripper cheeks, the gripping device 360 may also have pairs of plucking rolls or the like.

Figure 4:
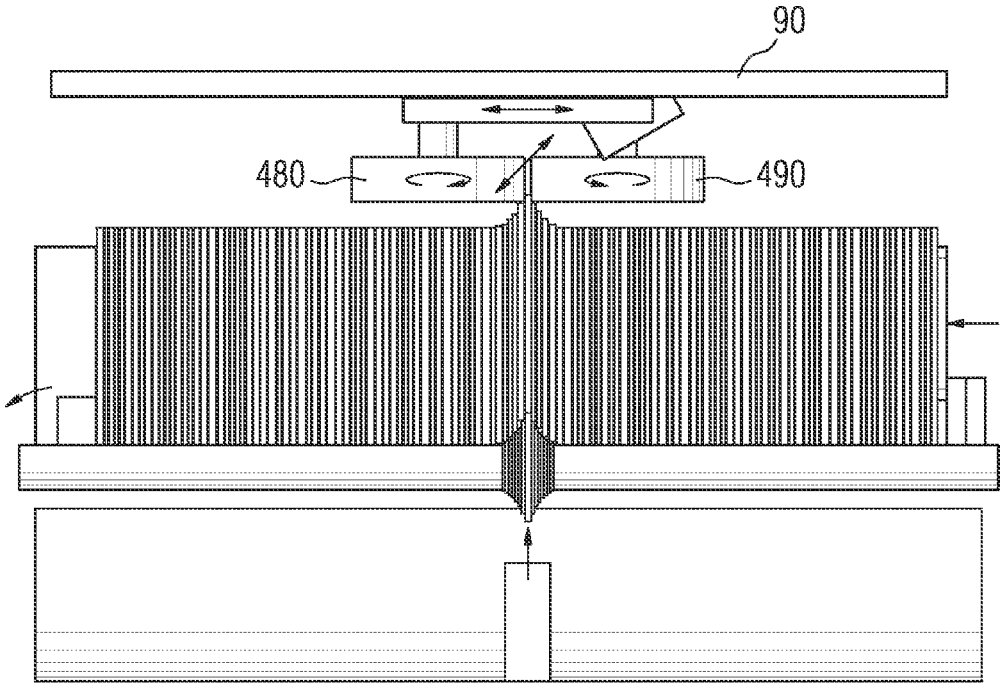
FIGS. 4 and 5 show a second exemplary embodiment for a removal device for the configuration according to FIG. 1.
Figure 5:
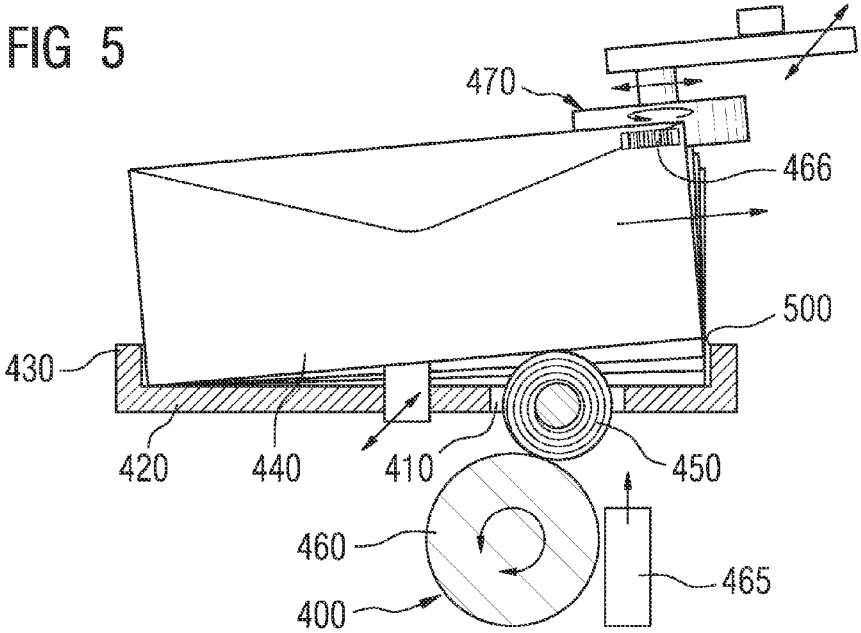

FIGS. 4 and 5 show a further exemplary embodiment for the first removal device 90 according to FIG. 1; FIG. 4 shows a view from the side and FIG. 5 a view from the front.

The removal device 90 according to FIGS. 4 and 5 has a raising device 400 which is suitable for reaching from below through openings 410 in the container base 420 of the storage container 430 in order to raise the item of mail 440 to be gripped from the bottom to the top.

The raising device 400 comprises, for example, a double cone spindle 450, the pitch of which is relatively small and the core diameter of which slopes relatively steeply upward and falls away again, i.e. has a conical shape.

The double cone spindle 450 is driven, for example, by a rotating driving roller 460, as a result of which said double cone spindle grasps one item of mail after the other and raises said item of mail by means of the rising and again dropping core diameter and subsequently lowers said item of mail again. As a result, the double cone spindle 450 winds through the mail stack until the item of mail to be removed is reached and raised. The double cone spindle 450 in FIG. 4 moves to the left or right depending on the direction of rotation. As an alternative, the double cone spindle 450 can also move linearly in a restrained manner, such as, for example, by mounting on a rotating threaded spindle.

A sensor, for example, an optical sensor in the form of a sheet counter 465 and/or barcode reader, is used to identify the item of mail to be removed, the absolute position region of which within the storage container 430 and the relative position of which to the other items of mail of a control unit of the removal device 90 are preferably known. Each item of mail 440 preferably has an unambiguous identification feature, for example in the form of a barcode 466.

A gripping device 470 which can move along the arrow directions shown in FIGS. 4 and 5 to the position of the item of mail to be removed is used to grasp the item of mail raised by the raising device 400 and to pull said item of mail obliquely out of the remaining stack. The gripping device 470 can comprise, for example, two plucking rolls 480 and 490 for gripping purposes.

The storage container is preferably configured in such a manner that the item of mail to be separated can be pulled out via a stripping edge 500 but the remaining items of mail are retained by the stripping edge 500.

Features of the exemplary embodiment according to FIGS. 2 and 3 can be combined with features of the exemplary embodiment according to FIGS. 4 and 5: in the case of the exemplary embodiment according to FIGS. 4 and 5, the items of mail can be provided, for example, with pull tabs in order to grip the items of mail by way of the pull tabs and to pull said items of mail out of the storage container. In the exemplary embodiment according to FIGS. 2 and 3, it is additionally possible for, for example, a raising device 400 to be provided in order to raise the items of mail prior to the removal thereof.

Figure 6:
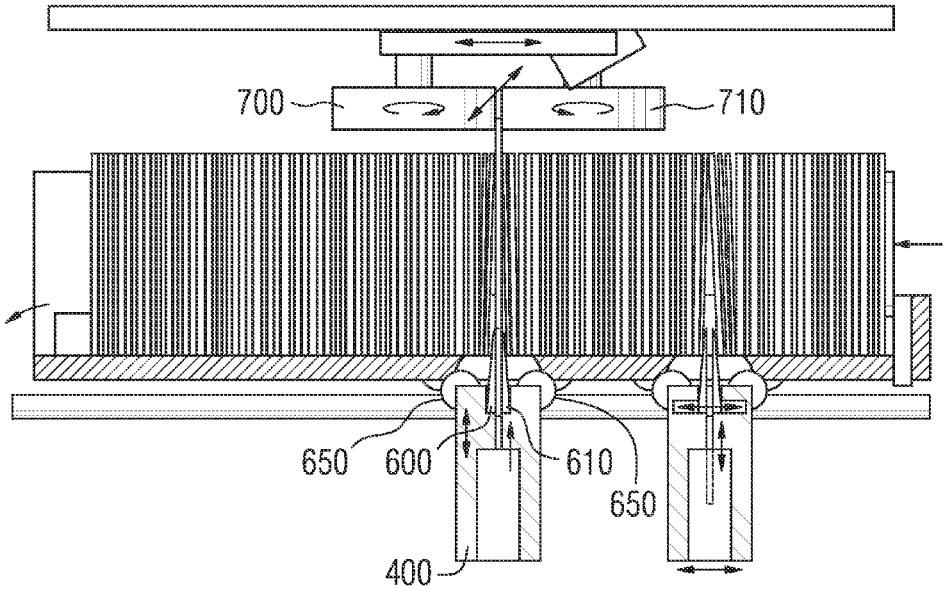
FIGS. 6 and 7 show a third exemplary embodiment for a removal device for the configuration according to FIG. 1.
Figure 7:
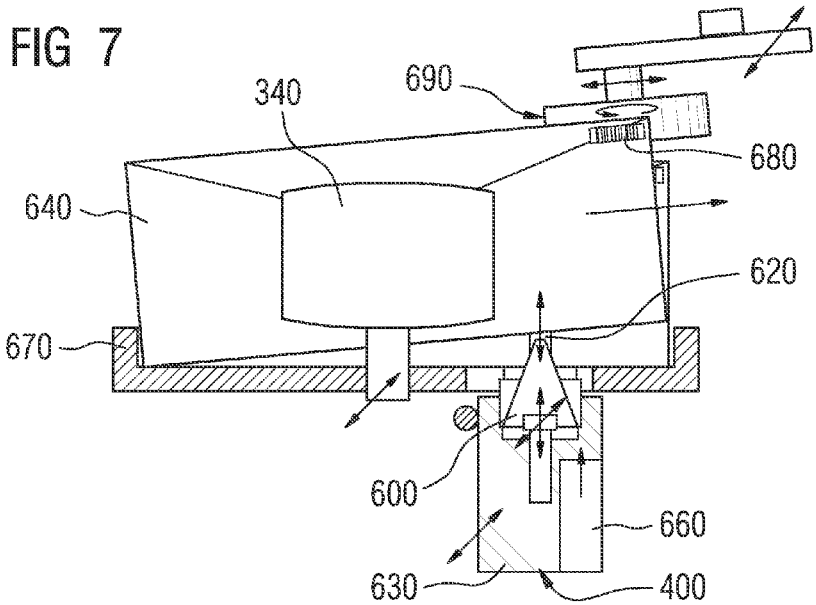

FIGS. 6 and 7 show a further exemplary embodiment for the first removal device 90 according to FIG. 1; FIG. 6 shows a view from the side and FIG. 7 a view from the front.

The exemplary embodiment according to FIGS. 6 and 7 differs from the exemplary embodiment according to FIGS. 4 and 5 in the configuration of the raising device 400.

The raising device 400 shown in FIGS. 6 and 7 has a pair of push-in wedges 600, 610 and a ram 620. The push-in wedges 600 and 610 are situated on a slide 630, the push-in wedges are designed to be relatively narrow and pointed and are displaceable horizontally independently of one another and vertically as a pair.

In order to raise an item of mail 640, the push-in wedges 600 and 610 are positioned on the adjacent interstices of the item of mail 640 to be removed, are displaced upward into said interstices and are moved apart. The ram 620 is pushed upward into the gap which is produced in this manner and in which the item of mail to be removed is located, the ram then raising the item of mail 640.

The push-in wedges 600 and 610 and the ram 620 advantageously intersect one another.

In an advantageous manner, brushes 650 which rotate next to the push-in wedges 600 and 610 are arranged on the left and right in FIG. 6 and increase the interstices next to the item of mail 640 to be removed, as a result of which the push-in wedges 600 and 610 can be safely submerged into said interstices. In addition, a discontinuous, alternating upward and sideways movement of the push-in wedges 600 and 610 is advantageous.

A sensor, for example an optical sensor in the form of a sheet counter 660 and/or barcode reader, is used to identify the item of mail which is to be removed, the absolute position region of which within the storage container 670 and the relative position of which to the other items of mail of a control unit of the removal device 90 are preferably known. Each item of mail 640 preferably has an unambiguous identification feature, for example in the form of a barcode 680.

A gripping device 690 which can move along the arrow directions shown in FIGS. 6 and 7 to the position of the item of mail to be removed is used to grasp the raised item of mail and to pull said item of mail obliquely out of the remaining stack. The gripping device 690 may comprise, for example, two plucking rolls 700 and 710 for gripping purposes.

Features of the exemplary embodiment according to FIGS. 2 and 3 can be combined, for example, with features of the exemplary embodiment according to FIGS. 6 and 7: thus, in the exemplary embodiment according to FIGS. 6 and 7, the items of mail can be provided, for example, with pull tabs in order to grip the items of mail by way of the pull tabs and to pull said items of mail out of the storage container. In the exemplary embodiment according to FIGS. 2 and 3, it is additionally possible for, for example, a raising device 400, as shown in FIGS. 6 and 7, to be provided in order to raise the items of mail prior to the removal thereof.

The invention claimed is:

1. A configuration for handling stored objects and for dividing at least one object to be processed and that is stored in a storage container from objects that are to remain in storage in the storage container, comprising:

a first removal device and a second removal device;

a switch configured for selectively feeding the storage container into said first removal device or into said second removal device; and a control device connected to said switch, said control device being configured to activate said switch depending on a number of objects to be processed or depending on a differential value between a total number of objects in the storage container and the number of objects to be processed and to allow the storage container to be fed by said switch into said first removal device or said second removal device;

said first removal device being configured to separate the object or objects to be processed from the objects to remain in storage inside the storage container and to remove the object or objects to be processed directly from the storage container, while the objects to remain in storage remain in the storage container during the removal operation; and said second removal device being configured to remove all of the objects from the storage container and to separate the object or objects to be processed from the objects to remain in storage outside of and separated from the storage container.

2. The configuration according to claim 1, wherein said second removal device has a sorting machine connected to said control device and configured for picking up all of the objects out of the storage container, for dividing the objects, for separating the object or objects to be processed from the objects to remain in storage, for sorting the objects to remain in storage according to object size and/or further storage time, and for putting the objects into assigned storage containers depending on their object size and/or further storage time.

3. A removal device for a configuration according to claim 1, comprising a gripping device suitable for gripping objects to be processed and for removing the objects from a storage container.

4. The removal device according to claim 3, comprising at least one of the following:

a dividing device configured for dividing each object prior to a removal thereof from the receiving container from adjacent objects in the receiving container; and/or a pull tab combing device configured for combing through pull tabs on the objects; and/or a pull tab counting device configured for counting the pull tabs as the pull tabs are being combed through; and/or a pull tab reading device configured for reading a coding on the pull tabs; and/or a raising device configured for reaching through openings formed in a container base of the receiving container in order to raise the objects to be processed from below; and/or a counting device configured for counting how many objects are involved during an object-raising operation.

* * * * *